US011359575B2

(12) United States Patent
Steiner et al.

(10) Patent No.: US 11,359,575 B2
(45) Date of Patent: Jun. 14, 2022

(54) METHOD FOR PRODUCING A CYLINDER HEAD AND CYLINDER BLOCK

(71) Applicant: Ford Global Technologies, LLC, Dearborn, MI (US)

(72) Inventors: Bernd Steiner, Duesseldorf (DE); Urban Morawitz, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 13 days.

(21) Appl. No.: 16/858,247

(22) Filed: Apr. 24, 2020

(65) Prior Publication Data

US 2020/0340425 A1 Oct. 29, 2020

(30) Foreign Application Priority Data

Apr. 29, 2019 (DE) ..... DE102019206086

(51) Int. Cl.

| | |
|---|---|
| ***F02F 7/00*** | (2006.01) |
| ***F02F 1/24*** | (2006.01) |
| ***F02F 11/00*** | (2006.01) |
| ***B22D 25/02*** | (2006.01) |

(52) U.S. Cl.

CPC ..... *F02F 7/0021* (2013.01); *F02F 1/24* (2013.01); *F02F 7/0002* (2013.01); *F02F 11/002* (2013.01); *B22D 25/02* (2013.01); *F02F 2200/06* (2013.01)

(58) Field of Classification Search

CPC ..... F02F 11/002; F02F 7/0002; F02F 1/24; F02F 7/0021

See application file for complete search history.

(56) References Cited

U.S. PATENT DOCUMENTS

2011/0049814 A1* 3/2011 Iwase ..... F16J 15/14 277/628
2011/0204581 A1* 8/2011 Takahashi ..... F16J 15/062 277/598

FOREIGN PATENT DOCUMENTS

| | | | | |
|---|---|---|---|---|
| DE | 102011088141 | A1 | | 7/2012 |
| EP | 2362120 | A1 | | 8/2011 |
| JP | 2003232258 | A | * | 8/2003 |
| JP | 2003232258 | A | | 8/2003 |

* cited by examiner

*Primary Examiner* — Kevin A Lathers
(74) *Attorney, Agent, or Firm* — Geoffrey Brumbaugh; McCoy Russell LLP

(57) ABSTRACT

Methods and systems are provided for a sub-assembly. In one example, a method for the subassembly includes separating a monoblock of the subassembly into two separate portions and applying a sealing material to at least one of the two separate portions and rejoining the portions.

20 Claims, 2 Drawing Sheets

METHOD FOR PRODUCING A CYLINDER HEAD AND CYLINDER BLOCK

CROSS REFERENCE TO RELATED APPLICATIONS

The present application claims priority to German Application No. 102019206086.2 entitled "METHOD FOR PRODUCING A CYLINDER HEAD AND CYLINDER BLOCK" filed on Apr. 29, 2019. The entire contents of the above-listed application are hereby incorporated by reference for all purposes.

FIELD

The present description relates generally to a sub-assembly for a cylinder head and a cylinder block.

BACKGROUND/SUMMARY

Internal combustion engines in motor vehicles or motor vehicle engines have a cylinder head and block arrangement in which a cylinder head and a cylinder block form one or more cylinders. The cylinder head and cylinder block may be produced separately using complex machining methods. For the subsequent installation in the engine, the cylinder head and the cylinder block may be mounted with screws or other suitable fastening devices. In this instance, a cylinder head seal may be placed between the cylinder head and cylinder block.

The cylinder head seal may be configured to seal the region between the cylinder head and the cylinder block. In addition to the objective of sealing the various media, such as gases, water, and oil in the engine, from each other and externally, cylinder head seals may be further used as a force transmission member. The cylinder head seal thus has, for instance between the cylinder head and cylinder block a considerable influence on the force distribution within the entire engine system.

There are further known examples in the art where methods include where individual components of a sub-assembly are produced using a fracture-splitting method. The fracture-splitting method is a separation method or division method. In this instance, components are "broken apart" at a previously determined location. At the fracture locations, precise fitting faces are consequently produced in the separated components for an assembly. In one example, the fracture-splitting method is used in previous examples in order to produce connecting rod bearings.

Fracture-split connecting rod bearings are in this instance initially produced using a casting method in one piece as a monoblock and provided with breaking notches during casting. At the scored locations, the monoblock is broken into two parts. The fracture faces fit precisely together and can be screwed when mounted on the crankpin of the crankshaft. The separation joint may be difficult to visualize on the mounted connecting rod bearing. As a result of the individual fracture geometry, both components of a connecting rod bearing belong together and may not be individually changed. Fracture-split connecting rods afford advantages with regard to strength, production precision and production costs. A precise fit between the components is provided and the force transmission is improved compared to two separately produced components.

Thus, for example, in DE 10/2011/088141A1, the crankshaft carriers are formed with the cylinder block from an integral material piece by first being produced using a single casting operation. The crankshaft carriers can after casting be split off from the cylinder block or separated in another manner so that a crankshaft can be mounted on the crankshaft carrier.

The production methods known from the prior art for a sub-assembly with a cylinder head and a cylinder block may be susceptible to engine degradation, in particular, the cylinder head seal provided in the connection region of the cylinder head and cylinder block is prone to degradation.

With regard to the previous example described above, there is a desire for an improved method. An object of the present disclosure is to reduce the probability of engine degradation. According to the present disclosure, the problems described above are at least partially solved by a method for producing a sub-assembly having a cylinder head and a cylinder block for an internal combustion engine, in particular for an engine of a motor vehicle, wherein the cylinder head and the cylinder block together form one or more cylinders of the internal combustion engine, the method, comprising forming a monoblock having the cylinder head and the cylinder block integrally connected, separating the monoblock into two components of the sub-assembly, wherein a first component has the cylinder head and a second component has the cylinder block, and connecting the cylinder block and the cylinder head are connected to each other in a fluid-tight manner.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
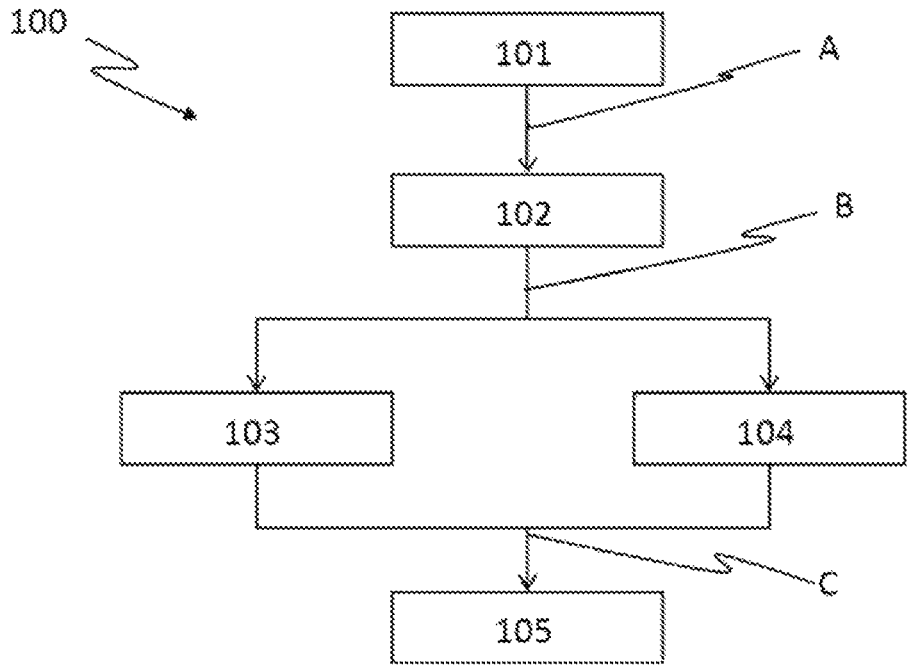
FIG. 1 is a flow diagram of an exemplary production method according to the disclosure.
Figure 2A:
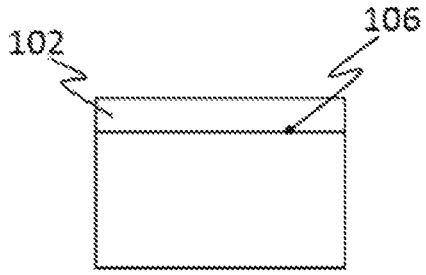
FIG. 2*a* is a schematic drawing of a first intermediate product of an exemplary production method according to the disclosure.
Figure 2B:
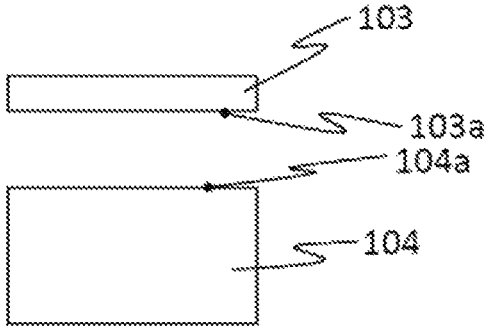
FIG. 2*b* is a schematic drawing of a second intermediate product of an exemplary production method according to the disclosure.
Figure 2C:
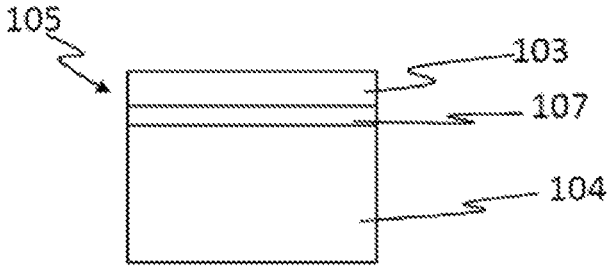
FIG. 2*c* is a schematic drawing of an exemplary sub-assembly according to the disclosure.
Figure 3:
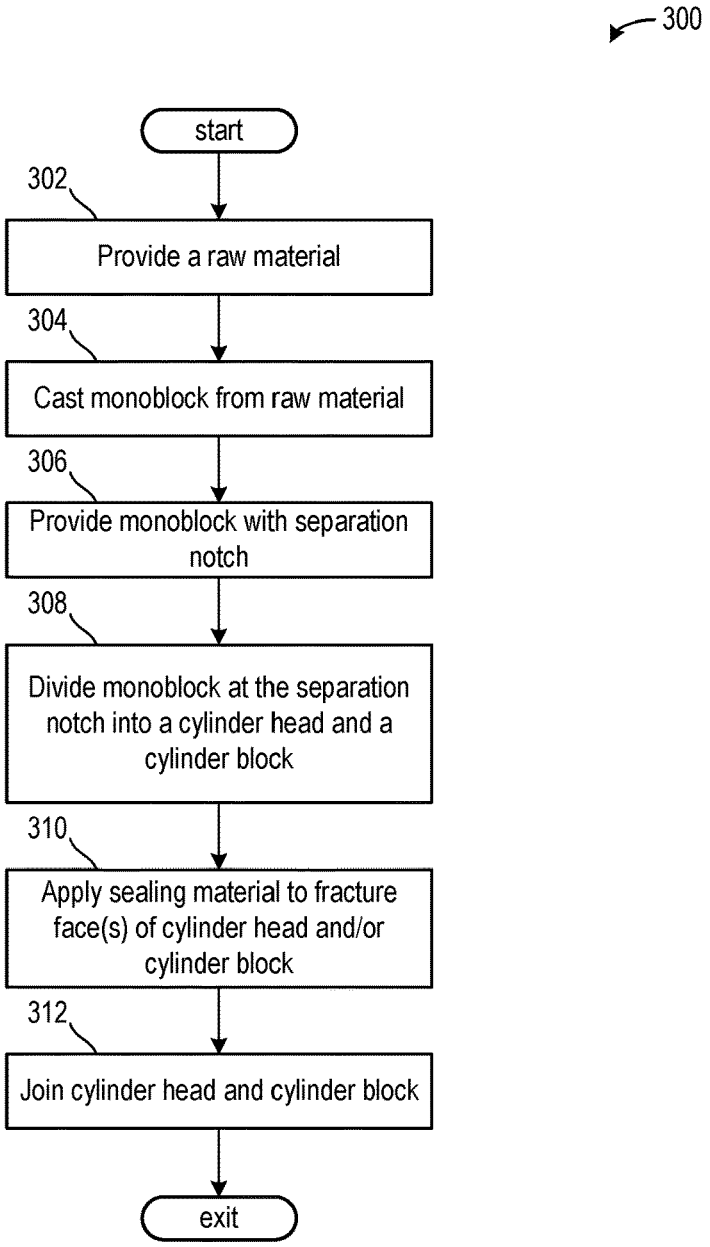
FIG. 3 is a method for assembling a cylinder head and cylinder block of an engine.

The following description relates to systems and methods for production of an engine comprising a cylinder head and a cylinder block. FIG. 1 shows a flow diagram of an exemplary production method according to the disclosure. FIG. 2*a* shows a schematic drawing of a first intermediate product of an exemplary production method according to the disclosure. FIG. 2*b* shows a schematic drawing of a second intermediate product of an exemplary production method according to the disclosure. FIG. 2*c* shows a schematic drawing of an exemplary sub-assembly according to the disclosure. FIG. 3 shows a method for assembling a cylinder head and cylinder block of an engine.

The disclosure relates to a method for producing a sub-assembly having a cylinder head and a cylinder block for an internal combustion engine, in particular for an engine of a motor vehicle, wherein the cylinder head and the cylinder block together form one or more cylinders of the internal combustion engine. The production method comprises in a first production step where a monoblock is formed, wherein a cylinder head and a cylinder block are integrally connected to each other. In a second production step which follows the first production step, the monoblock is separated into two or more components of the subassembly, wherein a first component has the cylinder head and a second component has the cylinder block. In a third production step which follows the second production step, the cylinder block and the cylinder head are connected to each other in a fluid-tight manner.

The fluid-tight connection in the third production step may be produced as a releasable connection with screws or as a non-releasable permanent connection with an adhesive or with mechanical joining elements. As a result of the fluid-tight connection between the cylinder head and cylinder block, the media which flow inside and/or between the cylinder head and cylinder block, such as gases, water and oil, are sealed from each other in the engine and sealed externally toward the environment. The method according to the disclosure for producing a cylinder head/cylinder block arrangement affords various advantages. Above all, it is possible to dispense with the cylinder head seal, whereby engine degradation as a result of a degradation of the cylinder head seal is eliminated. The durability of a motor vehicle can thereby be improved.

Preferably, the monoblock which has the cylinder head and the cylinder block is cast in one piece in the first production step.

With a single production step, at least two components of the engine can consequently be produced, for which previously at least two production steps, in particular two casting steps, were necessary. Consequently, only the production of a casting mold is still desired, which simplifies the production method.

In an advantageous embodiment, the monoblock is formed in the first production step with a separation notch, in particular cast, wherein the separation notch is formed so as to extend partially or completely around the monoblock.

A separation notch in the context of the disclosure may be understood to be any separation edge, separation line. or comparable desired breaking location which facilitates a starting location for a separation tool and/or enables the separation operation between the cylinder head and the cylinder head in a selective manner. The casting mold for the monoblock is in this instance constructed in such a manner that the separation notches can already be formed when the casting mold is poured out.

Preferably, the monoblock is separated and/or split and/or broken along the separation notch in the second production step.

The separation method in the second production step is in particular constructed as a fracture-splitting method or splitting method. Other methods for separation, for example, sawing or laser melting, may in principle also be considered. After the separation, the separation or fracture faces can be subsequently processed by means of milling, machining or grinding. The same applies to the remaining faces of the cylinder head and cylinder block which after the pouring are brought into the final shape using machining methods, for example, by valve seats, channels and/or other such elements which a combustion engine has being formed.

In an advantageous optional development of the disclosure, in the second production step the cylinder head is formed with a first separation or fracture face and the cylinder block is formed with a second separation or fracture face, wherein the first separation or fracture face and the second separation or fracture face are formed with mutually complementary surface structures.

As a result of the fracture-splitting method, precise fitting faces are produced on the components cylinder head and cylinder block which are separated from the monoblock in order to be able to precisely position them at the fitting faces during subsequent connection or joining. The separation or fracture faces are formed individually for each fracture-splitting operation. By appropriately selecting the material, the separated components are prevented from splintering in the fracture-splitting method. Consequently, however, a cylinder head can subsequently be placed exclusively on the cylinder block, to which it was previously connected in the monoblock. In the event of maintenance, the cylinder head and cylinder block can be replaced only together. A complex processing of the connection region in order to produce planar surfaces in the connection region between the cylinder head and cylinder block can also be dispensed with, which reduces the production costs.

In a preferred embodiment of the disclosure, before or in the third production step a sealing material is applied between the cylinder head and the cylinder block, in particular on a first separation or fracture face of the cylinder head and/or a second separation or fracture face of the cylinder block.

Such a sealing material is preferably provided so as to be flowable and/or plastically deformable during application, for example, as a resin, a paste, or a gel. Consequently, at a separation or fracture face with individual occurrences of unevenness, a uniform layer for sealing can also be produced. Therefore, this shape of the seal is ideal for the complementary surface structure of the fitting faces. Preferably, a resin is used as a sealing material. As a result of this method for producing the fluid-tight connection between the cylinder head and cylinder block, the production of a separate sealing component can be omitted. A fluid-tight connection in the context of the disclosure is one in which a discharge of any media, whether gaseous or liquid, is prevented.

In addition, the sealing material can be used to form an adhesive connection, in particular a permanent adhesive connection.

The adhesive material may in this instance at the same time constitute the sealing material or be formed in addition thereto. Preferably, the adhesive material is arranged in layers at both sides of the layer of sealing material. Alternatively, the adhesive material and the sealing material are formed as a single homogeneous layer, for example, of an adhesive resin. By using an adhesive material, the cylinder head and the cylinder block are fixedly and securely joined to each other. Consequently, the screw connections, in particular the cylinder head screws, can be omitted. This has the advantage that the stresses brought about by the cylinder head screws within the sub-assembly, in particular during the operation of the internal combustion engine, are completely prevented.

With the disclosure, the fracture-splitting method is selectively used to form from a cast monoblock which is provided with a separation joint a cylinder block and a cylinder block, which after separation and finishing processing of the internal combustion engine elements without the use of a cylinder head seal can nonetheless be connected to each other in a fluid-tight manner to form the internal combustion engine.

The object is also achieved with a sub-assembly, in particular a sub-assembly produced using an already described production method, having a cylinder head and a cylinder block for an internal combustion engine, in particular for an engine of a motor vehicle, wherein the cylinder head and the cylinder block together form one or more cylinders of the internal combustion engine.

In this instance, the cylinder head and the cylinder block are produced from an originally integral monoblock so that the cylinder head has a first separation or fracture face and the cylinder block has a second separation or fracture face, wherein the first separation or fracture face and the second separation or fracture face have mutually complementary surface structures.

Preferably, a connection region between the first separation or fracture face and the second separation or fracture face has a sealing material, preferably a sealing resin.

In an optional development of the disclosure, the connection region has an adhesive connection, in particular a permanent adhesive connection with an adhesive resin.

Other advantageous embodiments of the disclosure are disclosed in the dependent claims and the following description of the Figures. In the schematic drawings of an exemplary embodiment in each case:

In the different figures, identical components are provided with the same reference numerals, for which reason they are generally also only described once.

FIG. 1 is a flow diagram of an exemplary production method 100 according to the invention having the production steps A, B and C, wherein the intermediate products and the sub-assembly 105 according to the invention relating to this production method 100 are schematically illustrated in FIGS. 2*a-c*.

According to FIG. 1, in a first production step A, a monoblock 102 is cast integrally from a raw material 101. During casting or after casting, the monoblock 102 is provided with a separation notch 106 as a desired breaking location, wherein the separation notch 106 according to FIG. 2*a* extends partially or completely around the monoblock 102. The separation notch 106 subdivides the monoblock 102 into a first component which after the second production step B forms the cylinder head 103 and a second component which after the second production step B forms the cylinder block 104.

In the second production step B which follows the first production step A, the monoblock 102 is separated, broken or split along the separation notch 106 into the cylinder head 103 and the cylinder block 104. There is thereby produced according to FIG. 2*b* the cylinder head 103 with a first separation or fracture face 103*a* and the cylinder block 104 with a second separation or fracture face 104*a*. As a result of the formation of the monoblock 101 with brittle material, after separation, splitting or fracture-splitting, the first separation or fracture face 103*a* and the second separation or fracture face 104*a* are formed with mutually complementary surface structures without material splintering from the monoblock 102. If the first separation or fracture face 103*a* and the second separation or fracture face 104*a* were to be placed on each other again after the separation operation, the connection region thereby formed would hardly be visible to the naked eye.

Furthermore, in a third production step C following the second production step B, the components cylinder block 104 and cylinder head 103 previously separated in the production step B are again connected to each other in a sealed or fluid-tight manner, wherein to this end before or during the third production step C a thin layer of sealing material is applied to the first separation or fracture face 103*a* of the cylinder head and/or the second separation or fracture face 104*a* of the cylinder block. According to FIG. 2*c*, at the connection region between the cylinder head 103 and cylinder block 104, an adhesive connection 107 can be used as a sealing material for a permanent connection to construct the sub-assembly 105.

FIGS. 2*a*-2*c* show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 3, it shows a method 300 for fabricating an engine comprising a cylinder head and a cylinder block. The method 300 begins at 302, which includes providing a raw material. In one example, the raw material is cast iron, aluminum, or an alloy thereof.

The method 300 proceeds to 304, which includes casting a monoblock from the raw material. The monoblock may be shaped to comprise a cylinder head and a cylinder block.

The method 300 proceeds to 306, which includes providing the monoblock with a separation notch. The separation notch may extend partially around the monoblock or may extend around an entire perimeter of the monoblock. The separation notch may mark a divide between the cylinder head and the cylinder block.

The method 300 proceeds to 308, which includes dividing the monoblock at the separation notch into the cylinder head and the cylinder block. By doing this, the cylinder head comprises a head fissure surface and the cylinder block comprises a block fissure surface, wherein the head fissure surface and the block fissure surface were previously in face-sharing contact prior to dividing the monoblock at the separation notch.

The method 300 proceeds to 310, which includes applying a sealing material to a fracture face of the cylinder head and/or the cylinder block. The sealing material may be optionally combined with an adhesive material.

The method 300 proceeds to 312, which includes joining the cylinder head to the cylinder block. In one example, the head fissure surface and the block fissure surface are joined together via one or more of an adhesive material, a plurality of fasteners, and other similar coupling devices. As such, the cylinder head and the cylinder block are joined with a fluid sealant arranged therebetween such that the issues described above with regard to fluid leaks following a degradation of the head and block are avoided.

In this way, a method of manufacturing a subassembly comprises dividing a cylinder head from a cylinder block via a separation notch shaped into a monoblock comprising the cylinder head and the cylinder block. The technical effect of separating the head and the block from the monoblock is to introduce a sealing material between the head and the block to mitigate a likelihood of a leak forming between the head and the block.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for producing a sub-assembly having a cylinder head and a cylinder block for an internal combustion engine, including for an engine of a motor vehicle, wherein the cylinder head and the cylinder block together form one or more cylinders of the internal combustion engine, the method comprising:

forming a monoblock having the cylinder head and the cylinder block integrally connected;

separating the monoblock into two components of the sub-assembly, wherein a first component has the cylinder head and a second component has the cylinder block;

connecting the cylinder block and the cylinder head are connected to each other in a fluid-tight manner via an adhesive, the adhesive arranged in layers at both sides of a layer of a sealing material.

2. The method of claim 1, wherein casting the monoblock with the cylinder head and the cylinder block in one piece, and wherein cylinder head screws are omitted from connecting the cylinder block to the cylinder head.

3. The method of claim 1, wherein the forming comprises introducing a separation notch into the monoblock, wherein the separation notch extends partially or completely around the monoblock.

4. The method of claim 3, wherein the monoblock is separated, split, or broken along the separation notch.

5. The method of claim 3, wherein the separating comprises forming the cylinder head with a head fracture face and the cylinder block with a block fracture face, wherein the head fracture face and the block fracture face are formed with mutually complementary surface structures.

6. The method of claim 3, further comprising applying a sealing material on at least one of the head fracture face and the block fracture face.

7. The method of claim 6, wherein the sealing material further comprises an adhesive material.

8. A sub-assembly having a cylinder head and a cylinder block for an internal combustion engine, in particular for an engine of a motor vehicle, wherein the cylinder head and the cylinder block together form one or more cylinders of the internal combustion engine, wherein the cylinder head and the cylinder block are permanently physically coupled to one another at a head fissure face and a block fissure face comprising complementary features via an adhesive, wherein a sealing material comprising an adhesive material is applied to at least one of the head fissure face or the block fissure face, and wherein the adhesive is arranged in layers at both sides of the sealing material.

9. The sub-assembly of claim 8, wherein the sealing material is a sealing resin.

10. The sub-assembly of claim 8, wherein the adhesive material is a permanent adhesive material.

11. A method, comprising:

providing a raw material;

casting a monoblock via the raw material;

shaping a separation notch at least partially around the monoblock;

dividing the monoblock at the separation notch into a first component comprising a cylinder head and a second component comprising a cylinder block;

applying a sealing material to a head fracture face and a block fracture face; and applying an adhesive to join the cylinder head and the cylinder block to form a permanent adhesive connection, the adhesive arranged in layers at both sides of the sealing material.

12. The method of claim 11, wherein the raw material is one or more of cast iron, aluminum, or an aluminum alloy.

13. The method of claim 11, wherein the separation notch corresponds to a split or a break in the monoblock.

14. The method of claim 11, wherein dividing the monoblock forms the head fracture surface on the cylinder head and the block fracture surface on the cylinder block.

15. The method of claim 14, wherein the head fracture surface and the block fracture surface comprise complementary surface features.

16. The method of claim 14, wherein the sealing material is a sealing resin comprising an adhesive material.

17. The method of claim 14, wherein the sealing material is configured to block leakage of a fluid from a cylinder shaped by the cylinder head and the cylinder block.

18. The method of claim 14, wherein the sealing material comprises an adhesive material for fixedly coupling the cylinder head and the cylinder block.

19. The method of claim 18, wherein the cylinder head and the cylinder block are fixedly coupled without fasteners.

20. The method of claim 11, wherein casting the monoblock comprises casting the monoblock as a single-piece.

* * * * *